United States Patent [19]

van der Lely

[11] 3,975,873

[45] Aug. 24, 1976

[54] PREFABRICATED BUILDING SECTIONS OR ROOM UNITS AND METHODS FOR THEIR USE IN ERECTING BUILDINGS

[76] Inventor: Cornelis van der Lely, 7, Bruschenrain, Zug, Switzerland

[22] Filed: Aug. 20, 1973

[21] Appl. No.: 389,818

[30] Foreign Application Priority Data

Aug. 21, 1972 Netherlands ..... 7211388

[52] U.S. Cl. ..... 52/79; 52/236

[51] Int. Cl.[2] ..... E04H 1/04

[58] Field of Search ..... 52/79, 236, 745, 280, 52/251

[56] References Cited

UNITED STATES PATENTS

| | | | |
|---|---|---|---|
| 980,480 | 1/1911 | Bishop | 52/725 |
| 3,289,382 | 12/1966 | van der Lely | 52/79 |
| 3,293,814 | 12/1966 | Zugehor | 52/789 |
| 3,355,852 | 12/1967 | Lally | 52/725 |
| 3,416,273 | 12/1968 | Stucky | 52/79 |
| 3,466,818 | 9/1969 | van der Lely | 52/236 |
| 3,470,660 | 10/1969 | van der Lely | 52/79 |
| 3,484,999 | 12/1969 | van der Lely | 52/79 |
| 3,824,750 | 6/1973 | Antoniou | 52/79 |

FOREIGN PATENTS OR APPLICATIONS

| | | | |
|---|---|---|---|
| 1,534,804 | 9/1969 | Germany | 52/236 |
| 608,401 | 9/1960 | Italy | 52/79 |
| 485,924 | 3/1970 | Switzerland | 52/725 |
| 2,449 | 10/1861 | United Kingdom | 52/727 |
| 379,700 | 9/1932 | United Kingdom | 52/236 |

*Primary Examiner*—John E. Murtagh

*Attorney, Agent, or Firm*—Mason, Mason & Albright

[57] ABSTRACT

A multistory building constructed of prefabricated parallelepiped sections, each of which has a similar framework of metal beams disposed at the section's edges, the upright beams at the vertical edges being hollow and disposed so that in superimposed sections they are abutting, said upright beams being covered with concrete for fireproofing and filled with concrete to extend between abutting beams rigidly to connect same.

30 Claims, 7 Drawing Figures

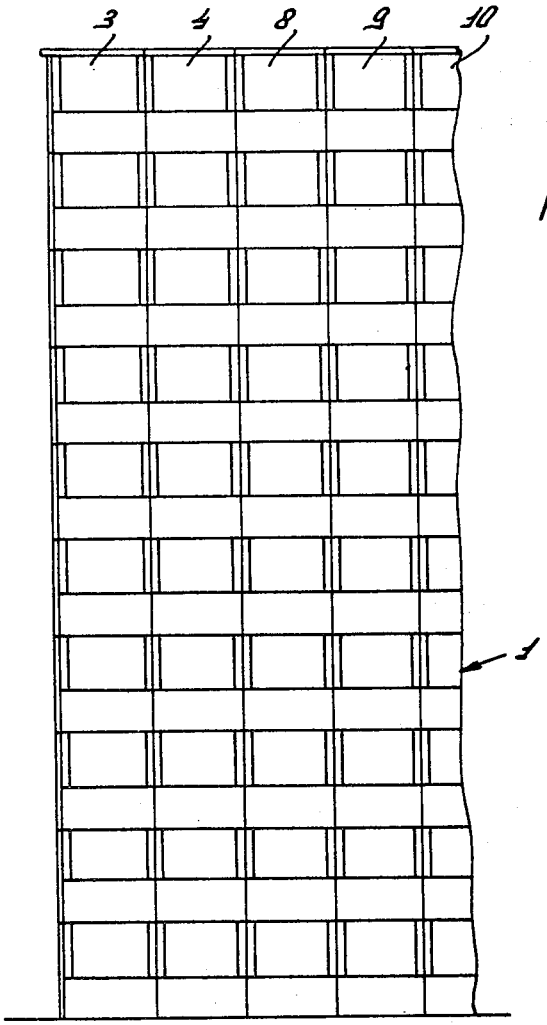
FIG. 1
FIG. 6
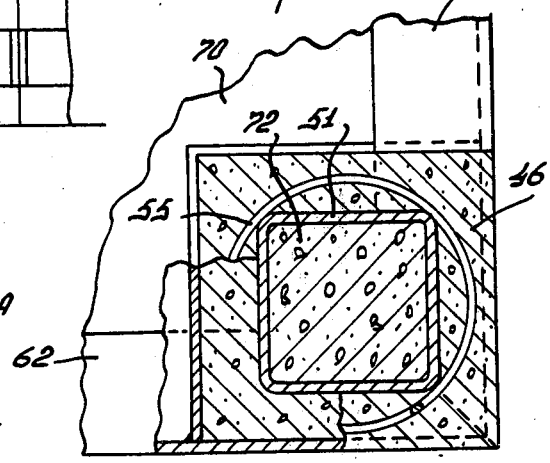
FIG. 5
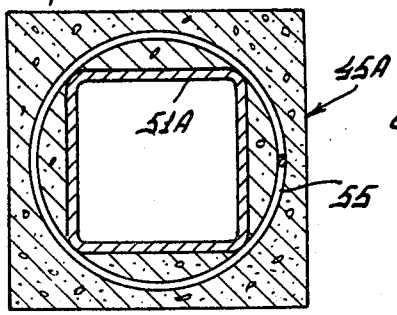

PREFABRICATED BUILDING SECTIONS OR ROOM UNITS AND METHODS FOR THEIR USE IN ERECTING BUILDINGS

SUMMARY OF THE INVENTION

This invention relates to prefabricated building sections or room units and to methods for their use in erecting buildings. Such prefabricated building sections are of the kind comprising a framework of metal beams and building components such as, at lease one wall or other partition and/or a floor and a ceiling.

In accordance with one aspect of the invention, there is provided a section of the kind set forth, wherein at least one vertical beam of the framework is embraced by fireproof material substantially throughout its length and around at least part of its periphery as seen in cross-section.

For a better understanding of the invention, and to show how the same may be carried into effect, reference will now be made, by way of example, to the accompanying drawings, in which:

BRIEF DESCRIPTION OF THE DRAWINGS

FIG. 1 is a diagrammatic elevation of part of a prefabricated building constructed in accordance with one aspect of the invention, FIG. 5 is a section, to an enlarged scale, taken on the line V—V V of FIG. 3, FIG. 6 is a section, to an enlarged scale, taken on the line VI—VI of FIG. 3.

DESCRIPTION OF THE PREFERRED EMBODIMENT

Figure 2:
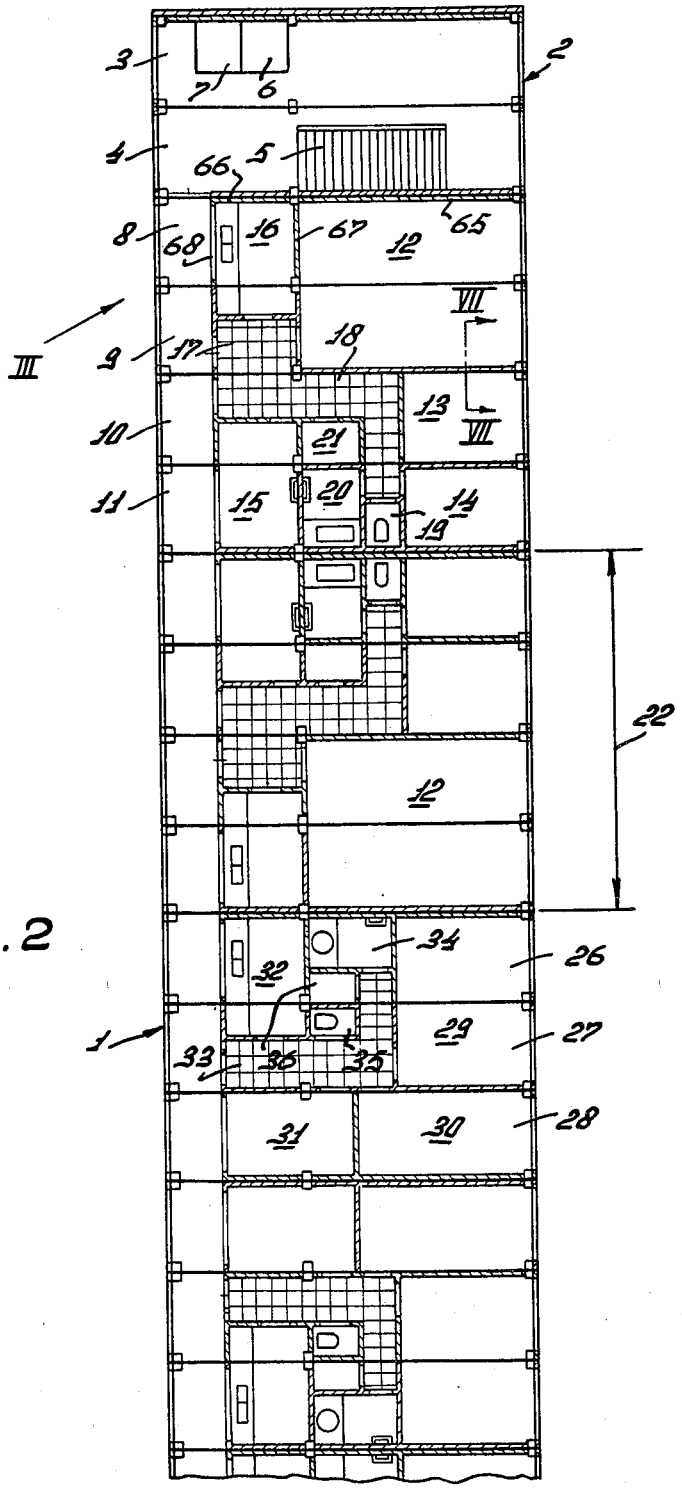
FIG. 2 is a somewhat diagrammatic horizontal section through part of the upper story of the building of FIG. 1.

Referring to the drawings, the building 1 shown in FIG. 1 is a block of apartments formed substantially completely from prefabricated three-dimensional building sections or room units. Each story of building 1 includes a plurality of adjoining apartments each of which is afforded by a plurality of appropriate building sections disposed in juxtaposed relationship. Apartments of different sizes can be provided by forming them from lesser or greater numbers of building sections.

FIG. 2 of the drawings illustrates part of the top story of the building 1 and it will be seen from that Figure that, at one end 2 of the elongated building 1, there are two adjoining sections 3 and 4 that afford a landing giving access to a staircase 5 and to two elevator shafts 6 and 7. At the side of the section or unit 4 that is remote from the section or unit 3, four sections or units 8, 9, 10 and 11 are arranged in successively adjoining juxtaposed relationship to form one apartment. As can be seen somewhat diagrammatically in FIG. 2 of the drawings, the building sections 8 to 11 thereof are provided with internal and external walls or other partitions to form a living room 12, three bedrooms 13, 14 and 15, a kitchen 16, a hall or vestibule 17, a corridor or passage 18, a toilet 19, a bathroom 20 and a storage room 21 at one side of the corridor or passage 18. Moving along the story illustrated in FIG. 2 from the end of the building 1, a further apartment is provided immediately beyond the one that has just been described, this further apartment being substantially symmetrically identical relative to a substantially vertical plane containing the junction between the two apartments. The further apartment that has just been mentioned has an over-all dimension 22, extending lengthwise of the building 1, that may conveniently have a magnitude of substantially 12 meters, this dimension being equal to the equivalent dimension of the apartment afforded by the four building sections 8 to 11 inclusive.

Passing along the story shown in FIG. 2 of the drawings beyond the second of further apartment or flat mentioned in the preceding paragraph, a third, smaller apartment is reached that is afforded by only three building sections 26, 27 and 28 arranged in successively adjoining juxtaposed relationship. The internal and external walls or other partitions that are provided in the building sections 26 to 28 inclusive define a living room 29, two bedrooms 30 and 31, a kitchen 32, a corridor or passage 33, a bathroom 34, a toilet 35 and a storage room 36 disposed between the bathroom 34 and the toilet 35. As mentioned above it is possible to form apartments, flats or other dwellings of larger or smaller sizes by employing an appropriate number of prefabricated building sections with suitable internal subdivisions.

Figure 3:
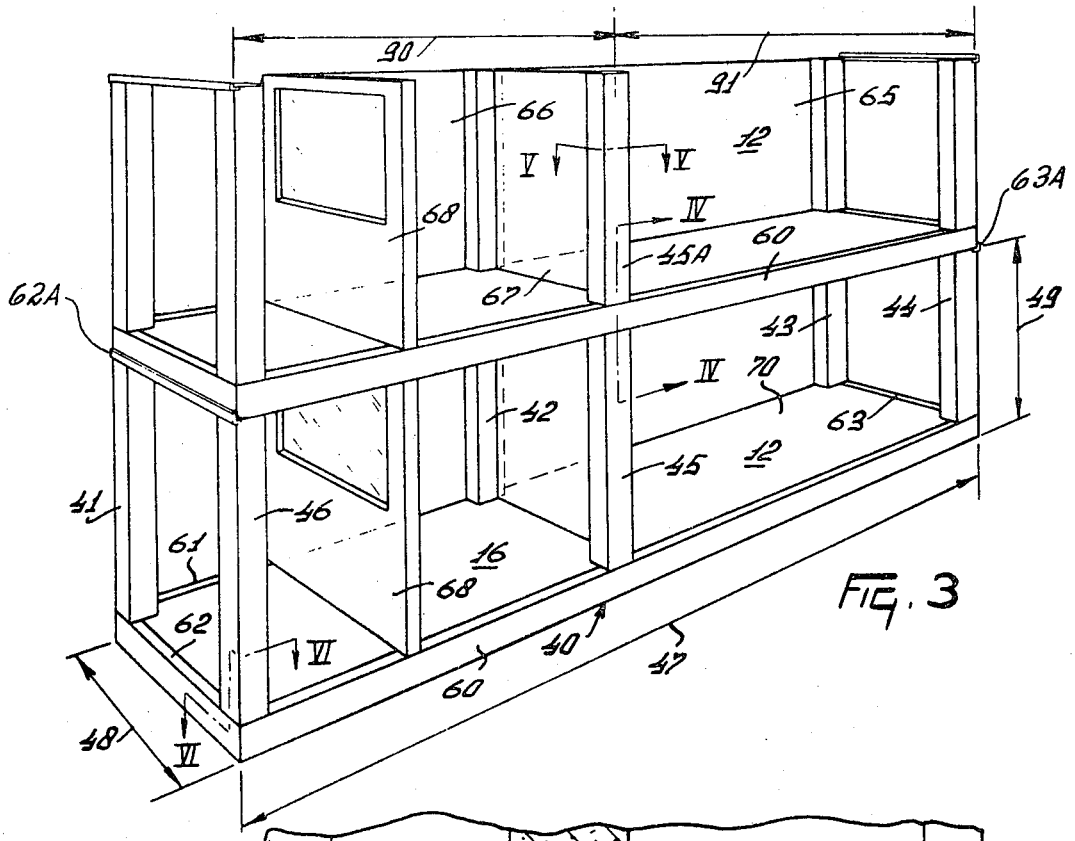
FIG. 3 is a perspective view, to an enlarged scale and as seen in the direction indicated by an arrow III in FIG. 2, illustrating two superposed prefabricated building sections of the building of FIGS. 1 and 2.

FIG. 3 of the drawings shows that each of the prefabricated building sections is afforded principally by a lower portion or floor panel 40 from the upper surface of which project a plurality of vertical supporting columns, the numbers of which depends upon the particular shape and function of the section concerned. Each of the two sections illustrated in FIG. 3 comprises six supporting columns 41, 42, 43, 44, 45 and 46 and it will be seen from FIG. 4 of the drawings that the lowermost end of one column bears directly upon the top of the corresponding column of the underlying section. The columns thus afford unbroken support for the building 1 from the foundation thereof to the top of the uppermost story. It is to be noted from FIG. 3 that the upper ends of columns 41 and 46 and also 43 and 44 are interconnected at their tops by guide beams which are substantially L-shaped in cross-section and are designated 62A and 63A respectively. Each building section has a length 47 that, in this embodiment, is substantially 12 meters with a width 48 that, in this embodiment, is substantially 3 meters. The height 49 of each section is substantially 3 meters in this embodiment but it is emphasised that any or all of the dimensions 47, 48 and 49 may be varied as required. It is clearly desirable that the dimensions should be as large as possible if the building 1 is to be formed from a minimum number of sections but it will, of course, be realized that limitations are effectively placed upon the maximum values of three dimensions by the technical difficulties involved in constructing and handling very large units without damage or distortion and the technical difficulties and legal regulations that prevent the transport of very large sections along public roads, railways and the like.

Figure 4:
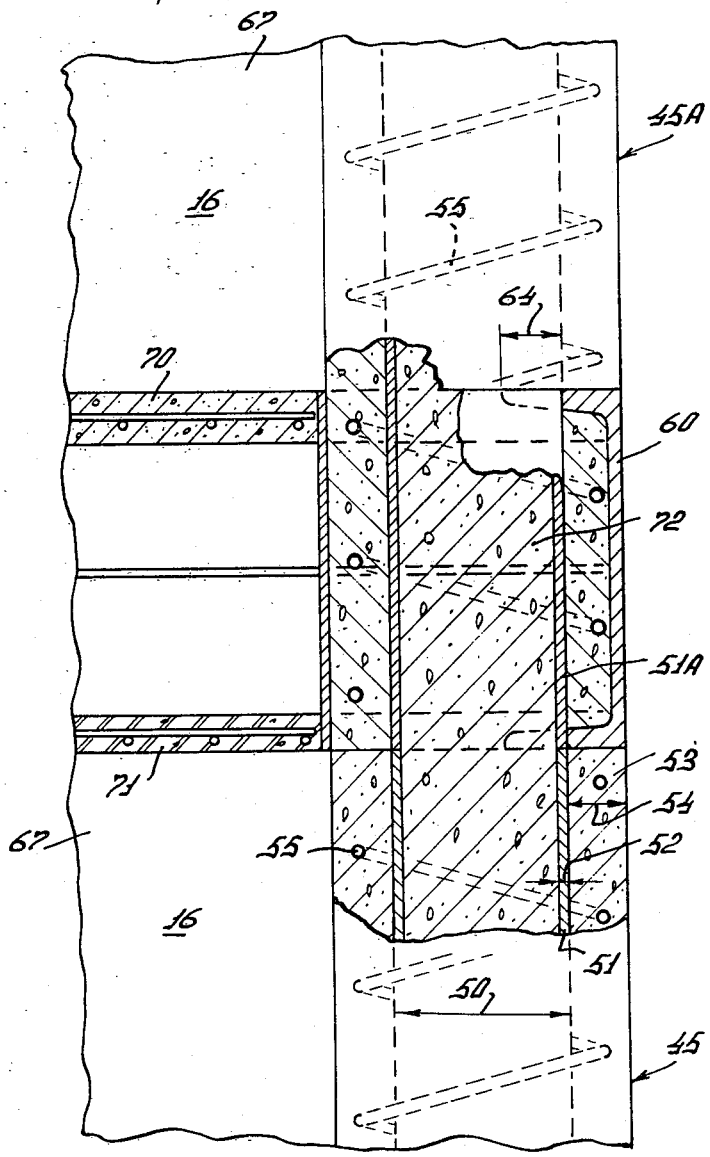
FIG. 4 is a section, to an enlarged scale, taken on the line IV—IV of FIG. 3.

FIGS. 4, 5 and 6 of the drawings show one of the columns 45 and an overlying column 45A, both these columns having a corresponding core in the form of a metal tube 51 of substantially square cross-section. In this embodiment, the tube 51 is 150 millimeters square and the metal from which the tube is formed has a thickness 52 (FIG. 4) of 10 millimeters. It will be evident that these dimensions are not mandatory and that alternative cross-sectional shapes and dimensions may be employed. The core afforded by the metal tube 51 extends throughout the height of the corresponding column 45 and, similarly, a tube 51A affording the core of the overlying column 45A extends throughout the height of that column. The same is true of the other supporting columns of all of the sections of the building 1 so that the strong metal tubes, which constitute the principal factors in giving the columns their load-bearing rigidity, extend in uniterrupted relationship from the foundation of the building to the top of its upper story. The tubes 51 and 51A are surrounded throughout substantially the whole of their lengths by sheath-like layers 53 of fireproof material. In the embodiment that is being described, the fireproof material is concrete having a thickness 54 (FIG. 4) of substantially 50 millimeters. Bonding of the concrete of the layers 53 to the outer surfaces of the metal tubes 51 and 51A is improved by winding a metal helix 55 around each tube between its upper and lowermost ends and preferably, but not essentially, welding the helix to at least some of the corners of the tubes 51 and 51A where the circumscribing (in plan view) helix touches those corners (see FIGS. 5 and 6). The concrete of the layers 53 surround the helices 55 as well as the tubes 51 and 51A. It is not essential that the fireproof material of the layers 53 should be concrete and it is emphasized that other fireproof materials may be arranged around the tubes 51 and 51A either by casting or in some other convenient manner.

The lower portions or floor panels 40 of the various building sections each comprise an oblong frame afforded by two longer parallel beams 60 and 71 and two shorter parallel beams 62 and 63 that are horizontally perpendicular to the beams 60 and 61. Each of the beams 60 and 63 is of channel-shaped cross-section and is so arranged that, in cross-sectional view, the base of the channel is substantially vertically disposed with the limbs projecting substantially horizontally towards the interior of the frame from the upper and lower edges of the base. The limbs of the beams 60 to 63 are welded or otherwise rigidly secured to the metal tubes 51 and 51A that afford the cores of the various supporting columns such as the columns 41 to 46 inclusive illustrated in FIG. 3. The sheath-like layers 53 of fireproof material around the tubes 51 and 51A are only interrupted over very short lengths of the supporting columns where those tubes are welded or otherwise rigidly secured to the flanges of the beams 60 and 63 inclusive. The flanges of the beams 60 and 63 are notched or otherwise recessed at the locations at which they are to cooperate with the columns 41 to 46, the widths of the notches or recesses being equal to the widths of the tubes 51 and 51A and the depths 64 (FIG. 4) of the notches or recesses having magnitudes that are substantially equal to one-third of the width of one of the tubes 51 or 51A so that the outer surfaces of the completed sheath-like layers 53 will be substantially coplanar with the outer surfaces of the bases of the beams 60 to 63 inclusive in the finished building sections as illustrated in the drawings. The notches or recesses that are formed in the limbs of the beams 60 to 63 inclusive at the four corners of the oblong frame, where those beams are rigidly interconnected, are appropriately shaped to receive the tubular cores of the columns 41, 43, 44 and 46, it being evident that the notches or recesses will be somewhat different in shape to those that co-operate with the cores of the columns 42 and 45. However, once again, the tubes 51 or 51A of the supporting columns at the corners of the sections or units are welded or otherwise rigidly secured to the flanges of the beams 60 to 63 inclusive at the corners of the frame which those beams define so that the whole of each unit will be of a strong and rigid construction.

Inner walls and other partitions may be arranged at the required locations in the various building sections so as to define the required rooms and other spaces in the building 1 or other building that is to be formed by assembling the sections. FIG. 3 of the drawings illustrates two similar building sections 8 in superposed relationship, FIG. 3 being a view as seen in the direction indicated by an arrow III in FIG. 2 of the drawings. Each of these sections 8 has a wall 65 extending between the columns 42 and 43, a partition 67 extending between the columns 42 and 45 and a wall 66 that extends from the column 42 towards the column 41 as far as a further relatively perpendicular wall 68 that is not directly connected to any of the columns. The wall 68 forms part of the front of the apartment that is afforded by the four juxtaposed building sections or room units 8, 9, 10 and 11 and it will be seen from FIGS. 2 and 3 of the drawings that the space between the wall 68 and an outer wall of the building 1 that substantially coincides with the columns 41 and 46 forms part of a gallery or hallway common to all of the apartments in the same story which gives access to all apartments from the landing defined by the sections or units 3 and 4 at the end 2 of the building. The outer wall of the building 1 that substantially coincides with the columns 41 and 46 preferably comprises a lower parapet and a large upper window in respect of each building section of each story as is shown somewhat diagrammatically in FIG. 1 of the drawings. The portions of the outer walls of the building 1 at each end of each building section will normally be provided during the prefabrication of that section even though the portions of the outer walls in question are not shown in FIG. 3 of the drawings. Since all of the inner and outer walls and other partitions are installed in the building sections prior to their delivery to the building site, only a minimum of finishing work is necessary in addition to the actual erection of the building. This finishing work may be limited substantially only to the structural interconnection of the various building sections and the interconnection of various service pipes and other conduits for water, gas, electricity, heating, telephone and like services. If, as is preferred, decorative wall coverings, cooking appliances, sanitary ware and the like are already installed in the sections prior to their delivery to the building site, only minor matters normally require attention after the building has been erected and the various structural and other connections have been made as mentioned above.

The lower portion or floor panel 40 of each building section comprises an upper load-bearing floor slab or plate 70 and a lower ceiling slab or plate 71. The ceiling slab or plate 71 affords the bottom of one story and the ceiling for the rooms and other spaces of the next underlying story. This allows each section to have an open top so that it is only necessary to provide additional parts at the ceiling level of the uppermost story of the building 1 or other building. It is, however, possible to interconnect the upper ends of the columns 40 to 46 by substantially horizontal beams but this is not shown in any detail in the accompanying drawings. Each section is strengthened to some extent by the internal walls and other partitions that are arranged between its supporting columns during prefabrication. Each completed section is, accordingly, of sufficient strength and rigidity to enable it to be mechanically handled and transported between the factory or the like at which it is made and its eventual position in a building such as the building 1. The strength and rigidity of the building sections are such that there is very little danger of distortion or breakage during such handling and transport.

Strong and reliable connections between superposed building sections can be established advantageously by casting material such as concrete internally of the tubes 51 and 51A that afford the cores of the supporting columns and, effectively, tubular frame beams of the sections. Such casting is effected after the sections have been placed in their appointed positions in a building such as the building 1. When the sections of the lowermost or ground floor story have been disposed on the foundation of the building, the interiors of the tubes 51 may be filled with liquid concrete up to, for example, approximately half their heights so that a satisfactory junction with the foundation and fastening to that foundation is achieved. To this end, the foundation itself is preferably provided with downwardly extending openings that register with the open lower ends of the tubes 51 of the columns forming parts of the lowermost story. When the sections of the lowermost story are in position with the tubes 51 registering with said openings, concrete is poured into the open upper ends of the tubes to fill the foundation openings and the tubes 51 themselves up to approximately half the heights of those tubes. Reinforcing mesh may, if considered necessary, be arranged in the foundation openings and in the interiors of the tubes 51 before the concrete is poured. A firm and reliable anchorage of the lowermost story to the foundation is thus effected. When the next story comprising a plurality of building sections is erected on top of the ground level or lowermost story, further concrete can be poured into the open upper ends of the tubes 51 or 51A of the supporting columns in that story so that the further concrete extends up to approximately half the height of the supporting columns of such story. It can be seen from FIG. 4 of the drawings that a mass 72 of concrete is thus formed that extends in an unbroken condition right through the junction between, for example, an underlying tube 51 and an aligned overlying tube 51A. Mesh or other reinforcing elements may, if considered necessary, be arranged at the junctions between the upper and lower tubes before the concrete of the mass 72 is poured so that said mass will be strengthened thereby when it has set. Each of the masses 72 constitutes an effective connection between each pair of vertically superposed tubes such as the tubes 51 and 51A. The superposed columns of the building sections thus constitute a satisfactory skeletal supporting structure for the whole building 1.

Figure 7:
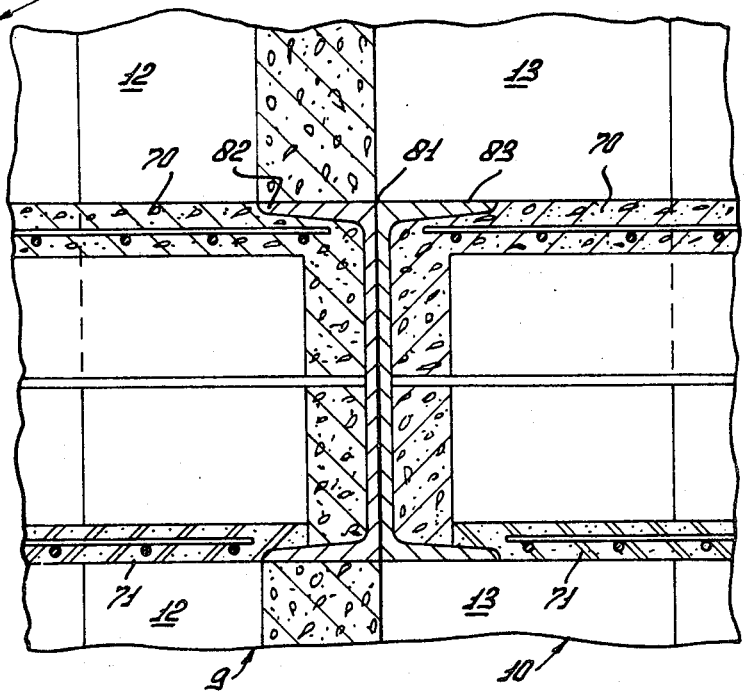
FIG. 7 is a section, to an enlarged scale, taken on the line VII—VII of FIG. 2.

The supporting columns of sections in lower stories of the building 1 are, of course, subject to heavier loads than are the columns of upper stories thereof. It is accordingly possible to form the tubular cores or frame beams of the columns in upper stories of the building from thinner metal than those of lower stories, that is to say, the thickness 52 (FIG. 4) may be varied in dependence upon the load which the corresponding column will have to bear which load will normally be dependent upon the horizontal level of that column in the building 1 or other building of which it is to form a part. Adjoining sections in a single story can be structurally interconnected by, for example, fastening abutting horizontal beams of such sections or units to one another. Such fastening can take the form of a row of spot welds and this is illustrated in FIG. 7 of the drawings where the abutting horizontal beams 82 and 83 of two floor panels (such as the floor panel 40 shown in FIG. 3) are interconnected by a line of spot welds 81. Since the supporting columns of the building that are formed by series of superposed columns of the individual building sections are of fireproof construction throughout their vertical lengths, the building sections have a very high resistance to combustion and the basic supporting parts of the building, in particular, are of a construction which will not burn for all practical purposes. Such a construction is particularly important in multiple story buildings. In the building 1 which has been described, the columns, such as the columns 41 to 46, of all of the sections or units of each story are located in strict vertical alignment. It is, however, possible to arrange at least some of the columns in at least some of the stories in relatively offset positions where this is more convenient for the particular internal divisions of the building that are desired. Under such conditions, horizontal supporting structures are provided in the building sections that have supporting columns which are laterally offset with respect to those of the sections or units of an underlying story.

It will be evident that supporting columns which extend throughout the heights of the various building sections and that are surrounded throughout substantially the whole of their vertical lengths by layers of fireproof material constitute a simple and satisfactory structure for the prefabrication of the three-dimensional building sections. Building sections of the kind that have been described are particularly, but not exclusively, advantageous for use in erecting multi-story buildings and it has been found that buildings which extend to five or more stories in height are particularly suitable for erection in a simple and economic manner using the described and illustrated building sections. The specified height 49 of substantially 3 meters is particularly suitable when the sections are principally intended for blocks of apartments but sections of other heights can readily be produced when, for example, they are to serve for the erection of office buildings or the like. Alternative internal and external walls and other partitions for office or other commercial use can readily be provided. The indicated length 47 of substantially 12 meters and width 48 of substantially 3 meters can also be changed if required and it is also possible to give the sections shapes other than the strict rectangular parallelepiped shape that has been described and illustrated. It is noted that, in the construction shown in FIG. 3 of the drawings, the columns 42 and 45 are located at a distance 90 of substantially 4½meters from the short end of the section or unit concerned which incorporates the columns 41 and 46 whereas the far end thereof which comprises the columns 43 and 44 is at a further distance 91 of substantially 7½meters from the columns 42 and 45. These distances 90 and 91, also, may be varied to meet the individual requirements of any particular building construction.

Although various features of the building sections and their methods of use in erecting buildings described and illustrated in the accompanying drawings will be set forth in the following claims as inventive features, it is emphasized that the invention is not limited to those features and includes within its scope all of the parts of the building sections described or illustrated or both and all of the steps in their methods of use described or illustrated or both, individually and in various combinations.

Having thus described my invention, what I claim as new and desire to secure by Letters Patent of the U.S. Patent Office is:

1. A box-shaped prefabricated section of a type to be included in a vertical stack of similar sections which form a completed multistory building, said section comprising a framework of beams which includes vertical metal beams which extend from the bottom to the top of the section and horizontal metal beams connecting said vertical metal beams at least along the lower aspects of said vertical metal beams, said lower horizontal beams defining at least in part the lowermost bottom side of the sections, said lowermost side of the section coincident with a horizontal plane which also defines the lowermost edges of said vertical beams which are spaced inboard from the periphery of said lowermost side of the section, said periphery being defined by said horizontal metal beams, said vertical beams each being embraced by fireproof material throughout substantially its entire length from the bottom to the top of the section including the space between each said vertical beam and said periphery and being adapted to join on at least one end with directly a similar vertical beam entirely embraced by fireproof material whereby whole columns are formed by said vertical beams throughout the entire height of the completed building which are protected with fireproof material throughout their entire length.

2. A section as claimed in claim 1, wherein said fireproof material is provided in the form of a sheath-like layer.

3. A section as claimed in claim 2, wherein said fireproof material is a castable material.

4. A section as claimed in claim 3, wherein said fireproof material is concrete.

5. A section as claimed in claim 1, wherein the lowermost end of each said vertical beam is rigidly secured along its vertical edge to at least one horizontal beam of said framework.

6. A section as claimed in claim 1, wherein each said vertical beam is of tubular formation.

7. A section as claimed in claim 1, wherein at least one horizontal frame beam of said framework affords support to a floor of the section which is secured to a lower end region of each said vertical beam at least on one side of the latter.

8. A section as claimed in claim 7, wherein the upper surface of a floor plate provided in the section is substantially coplanar with the upper surfaces of the horizontal beams of said framework in the lower region of said framework.

9. A section as claimed in claim 8, wherein said floor plate is formed substantially from concrete.

10. A section as claimed in claim 1, wherein the section is of rectangular configuration as seen in plan view.

11. A section as claimed in claim 51, wherein the longer side of the section has a magnitude of substantially twelve meters and its shorter side has a magnitude of substantially three meters.

12. A section as claimed in claim 10, wherein the section has two relatively parallel shorter sides as seen in plan view, and wherein the upper ends of the upright beams of said framework substantially coincide with said shorter sides which are interconnected at their tops by means affording guides.

13. A section as claimed in claim 10, wherein the upper ends of upright frame beams of said framework substantially coincide with longer sides of the section, as seen in plan view, and are coupled together by at least one further beam.

14. A section as claimed in claim 13, wherein the top of the section is substantially wholly open.

15. A box-shaped prefabricated section in accordance with claim 1, wherein the thickness of each of said vertical metal beams is dependent on the load it is to bear in the completed building.

16. A box-shaped prefabricated section in accordance with claim 1, wherein the thickness of each of said vertical metal beams is dependent on its horizontal level of the building of which it is to form a part.

17. A section as claimed in claim 1, wherein said vertical beams each constitute cores of supporting columns which are afforded by those beams and said embracing fireproof material, and wherein at least one wall member is arranged to extend between at least two of said supporting columns.

18. A section as claimed in claim 17, wherein said core of each supporting column is hollow in at least upper and lower end regions thereon, said regions being of open-ended construction.

19. A box-shaped prefabricated section which comprises a framework of horizontal and vertical beams with the upper side of the section open and the upper ends of said vertical beams comprising means for receiving a similar section of the next higher story, said framework including two said horizontal beams in a right-angled relationship which define in part between them a floor in said section, each of said two beams including a vertical web and at least one horizontal flange which extends inboard relative to said web, said two beams forming a lower corner of the section, a said vertical metal beam included in said framework extending vertically from said corner from the bottom to the top of the section, a lower portion of said latter vertical metal beam received in said corner formed by said two beams in an abutting relationship with the inboard edges of said flanges of said two beams and in a laterally spaced relationship with the webs of said two beams, fireproof material embracing said latter vertical beam substantially throughout its entire length including spaces between its lower portion and said web of said two horizontal beams.

20. A box-shaped prefabricated section in accordance with claim 19, wherein at least two vertical walls composed of a concrete type material are provided each of which extends between two of said vertical metal beams and joins the upper side of one of said horizontal beams in the lower side of the section.

21. A box-shaped prefabricated section in accordance with claim 19, wherein the webs of said two horizontal beams at said corner are embedded in said fireproof material.

22. A box-shaped prefabricated section in accordance with claim 19, wherein said horizontal beams are each channel-type beams, said fireproof material being received within the channel portions of said two horizontal beams between said webs and the sides of the lower portion of said vertical beam spaced therefrom.

23. A box-shaped prefabricated section of a type to be included in a vertically disposed stack of similar sections forming a multistory building, said section comprising a framework of beams including vertical metal beams, said vertical beams each being surrounded for their entire length by fireproof material and adapted to receive at their upper ends a like section with further vertical beams aligned therewith which also are surrounded for their entire length with fireproof material, the framework further including a lower horizontal frame comprised of beams each having a vertical web and a pair of spaced parallel flanges extending inboard from said web relative to said frame to which said vertical beams are rigidly secured, a floor for the section carried by said frame with the upper of said flanges included in said floor, a ceiling for the next lower section carried by said frame with the lower said flanges included in said ceiling, said ceiling being spaced below said floor, said vertical beams of said framework received in the space between said ceiling and said floor together with said surrounding fireproof material whereby said vertical beams of the framework are not directly exposed either in the space between said floor and said ceiling carried by said frame or in the space otherwise defined by the section.

24. A box-shaped prefabricated section in accordance with claim 23, wherein said vertical web is spaced from the lower portions of said vertical beams, said horizontal flanges abutting said lower portions.

25. A box-shaped prefabricated section of a type to be included in a vertically disposed stack of similar sections forming a multistory building, said section comprising a framework of beams including vertical metal beams, said vertical beams each being surrounded for their entire lengths by fireproof material and adapted to receive at their upper ends a like section with further vertical beams aligned therewith which are also surrounded for their entire length with fireproof material, the framework further including a lower horizontal frame comprised of beams each having a vertical web in a pair of spaced parallel flanges extending inboard from said web relativetto said frame to which said vertical beams are rigidly secured, said vertical web being spaced from the lower portions of said vertical beams, said horizontal flanges abutting said lower portions, said flanges including recessed portions which are profiled for receiving said vertical beams and the fireproof material surrounding same, a floor for the section carried by said frame, a ceiling for the next lower section carried by said frame, said ceiling being spaced below said floor, said vertical beams of said framework received in the space between said ceiling and said floor together with said surrounding fireproof material whereby said vertical beams of the framework are not directly exposed either in the space between said floor and said ceiling carried by said frame or in the space otherwise defined by the section.

26. A box-shaped prefabricated section of a type to be included in a vertical stack of similar sections which form a completed multi-story building, said section comprising a framework of beams which includes vertical metal beams which extend from the bottom to the top of the section and horizontal metal beams connecting said vertical metal beams at least along the lower aspects of said vertical metal beams, said lower horizontal beams defining at least in part the lowermost bottom side of the section, said lowermost side of the section coincident wth a horizontal plane which also defines the lowermost edges of said vertical beams which are spaced inboard from the periphery of said lowermost side of the section, said vertical beams each being embraced by a sheath-like layer of concrete throughout substantially its entire length from the bottom to the top of the section and being adapted to join on at least one end with a similar vertical beam entirely embraced by a like concrete sheath whereby whole columns are formed by said vertical beams throughout the entire height of the completed building which are protected with fireproof material composed of said concrete sheaths throughout their entire length, each said vertical beam of said framework being surrounded by a strengthening metal helix embedded in said vertical beams concrete sheath.

27. A section as claimed in claim 26, wherein at least the external cross-sectional configuration of said fireproof material around each said vertical beam is rectangular.

28. An elongated box-shaped prefabricated section which comprises a framework of metal beams, said framework including a rectangular lower horizontal frame of said metal beams defining a floor and at least part of the lowermost bottom side of the section which is coincident with a horizontal plane and four vertical beams received in the corners of said rectangular frame whereby the lower ends of said vertical beams extend to said lowermost bottom side of the section, two further vertical metal beams connected to horizontal beams comprising said frame on its longer sides, all of said vertical beams having their lower ends coplanar with said horizontal plane and being surrounded by fireproof material for substantially their entire lengths, said vertical beams abutting the inner vertical sides of the horizontal beams comprising said frame at its corners, said horizontal beams at said frame corners being spaced in part from the lower portion of said vertical beams, fireproof material being provided in the space between said horizontal beams at said frame corners and the lower portions of said vertical beams.

29. An elongated box-shaped prefabricated section which comprises a framework of metal beams, said framework including a rectangular lower horizontal frame of said metal beams which each include a vertical part and an inwardly extending horizontal flange, said horizontal frame defining a floor and at least part of the lowermost bottom side of the section which is coincident with a horizontal plane and four vertical beams received in the corners of said rectangular frame whereby the lower ends of said vertical beams extend to said lowermost bottom side of the section and are substantially spaced inwardly relative to the corners of said rectangular frame as defined by said vertical parts, two further vertical beams connected to horizontal beams comprising said frame on its longer sides and each being spaced inwardly said vertical part of the horizontal beam to which it is connected, all of said vertical beams having their lower ends coplanar with said horizontal plane and being surrounded by fireproof material for substantially their entire lengths including the space between each said vertical beam and the adjacent vertical part of the beam to which they are respectively connected.

30. An elongated box-shaped prefabricated section of a type to be included in a vertical stack of similar sections which form a completed multistory building, said section being of rectangular configuration and having two relatively parallel shorter sides as seen in plan view, said section comprising a framework of beams which includes vertical metal beams which extend from the bottom to the top of the section, the upper ends of said vertical metal beams substantially coinciding with said shorter sides of said section, only said upper ends of said vertical beams in each said shorter side being connected by a guide beam which has a cross-section substantially of the configuration of an upright L, the upper end of said vertical beams lying in a plane which is at least as high as the plane of the upper surfaces of the horizontal flanges of said L-shaped guide beams, said vertical metal beams each being embraced by fireproof material throughout substantially its entire length from the bottom to the top of the section and being adapted to join directly on at least one end with a similar vertical beam also entirely embraced by fireproof material whereby whole columns are formed by said vertical metal beams throughout the entire height of the completed building which are protected with fireproof material throughout their entire length.

* * * * *